United States Patent [19]

Strauss

[11] 4,018,360

[45] Apr. 19, 1977

[54] CASSETTE FOR DISPENSING YARN REELS

[75] Inventor: Friedrich Strauss, Bonnigheim, Germany

[73] Assignee: Amann & Söhne, Bonnigheim, Germany

[22] Filed: Jan. 5, 1976

[21] Appl. No.: 645,010

[52] U.S. Cl. ..... 221/310; 242/137

[51] Int. Cl.[2] ..... B65H 49/18

[58] Field of Search ..... 242/130, 132, 134, 137, 242/137.1, 138; 220/23.4; 206/503–505, 509, 514–520; 312/107; 221/307, 309, 310

[56] References Cited

UNITED STATES PATENTS

| | | | |
|---|---|---|---|
| 2,844,248 | 7/1958 | Tiberio | 220/23.4 |
| 3,343,705 | 9/1967 | Erickson | 220/23.4 |
| 3,581,906 | 6/1971 | Voyce | 206/509 X |

FOREIGN PATENTS OR APPLICATIONS

| | | | |
|---|---|---|---|
| 210,667 | 2/1964 | Sweden | 221/309 |

*Primary Examiner*—Leonard D. Christian
*Attorney, Agent, or Firm*—Cullen, Settle, Sloman & Cantor

[57] ABSTRACT

This invention relates to a cuboid cassette having channels extending one above the other for receiving yarn reels in a yarn-dispensing device. At least a pair of said cassettes are arranged side-by-side and assembled together by cooperating tongue and groove formations in their respective opposed side walls. Upright side projections at the front of each cassette define upright channels receiving a color strip to retain the cassettes against relative longitudinal movement.

1 Claim, 5 Drawing Figures

CASSETTE FOR DISPENSING YARN REELS

BACKGROUND OF THE INVENTION

Dispensing devices, particularly those of the self-service type are intended to make the merchandise readily accessible and to offer it in an easily inspectable manner to the buyer. These objectives are attained to a large extent by most of the dispensing devices known in the art. On the selling side, however, there remains the requirement to provide for a yarn-dispensing device that presents to the buyer a wide range of goods in keeping with his requirements and his demand.

SUMMARY OF THE INVENTION

It is therefore an object of the invention to provide a casette which is so constructed that a dispensing device equipped therewith possesses a high degree of flexibility relative to housing yarns of different make-up, i.e., to make it readily adaptable by combining certain casette types to different yarn reel sizes that are in demand.

This object is attained in accordance with the invention by making the casette positively connectable to the casettes lying adjacent thereto and providing at the vertical edges of the respective front output side projections with opposed upright grooves extending parallel to the front side, into which grooves rails can be slid serving as to indicate strips for color and number, with the rails preventing the casettes from shifting with respect to one another in longitudinal direction.

Due to this structure it is possible to arrive at an assembly of casetts having the same or a different number and size of yarn reel channels so as to constitute mechanical dispensing devices that will live up to respective requirements. No longer is there any need for the customary expense in design and construction for the dispensing device inasmuch as it will only be required now to provide a frame structure for receiving the casettes.

Lateral coherence of the casettes is achieved by the positive connection of the lateral members. A mutual shift of the casettes in their longitudinal direction is prevented in that projections with an outward directed groove extending parallel to the front side are provided at the vertical edges of the front and/or withdrawal side. A rail serving at the same time as an indicating strip for color and number is slid into the groove between adjacent casettes.

The invention will now be described in connection with the drawings illustrating some embodiments of the invention, wherein:

THE DRAWINGS

DETAILED DESCRIPTION OF THE INVENTION

Figure 1:
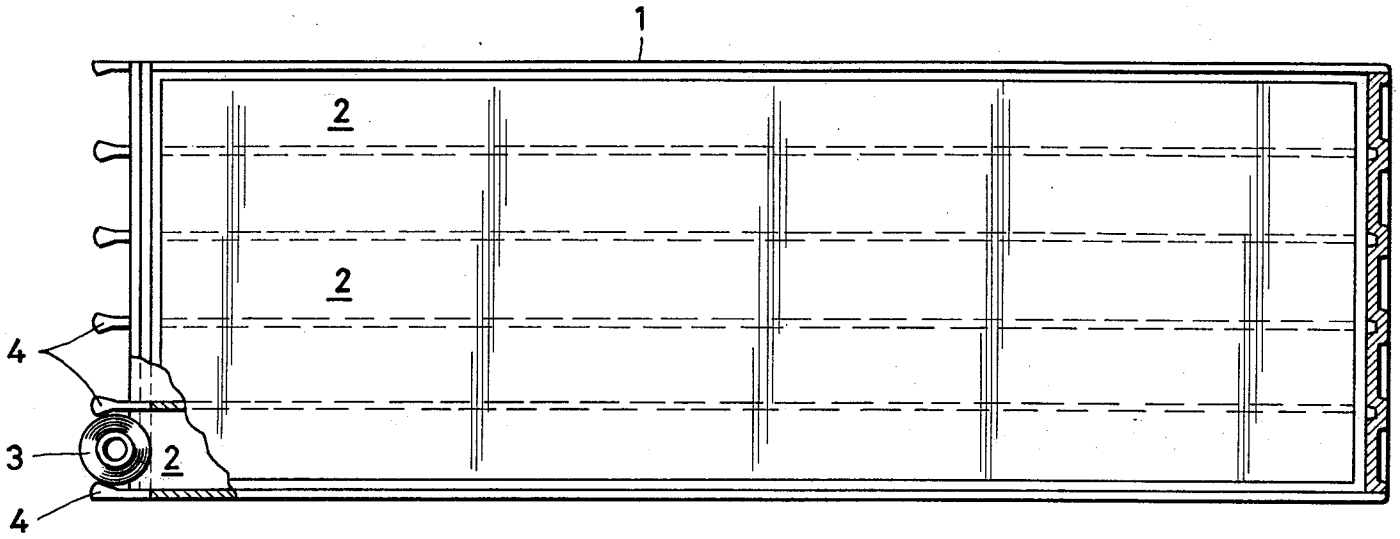
FIG. 1 is a side view, partially in section, of the casette.
Figure 2:
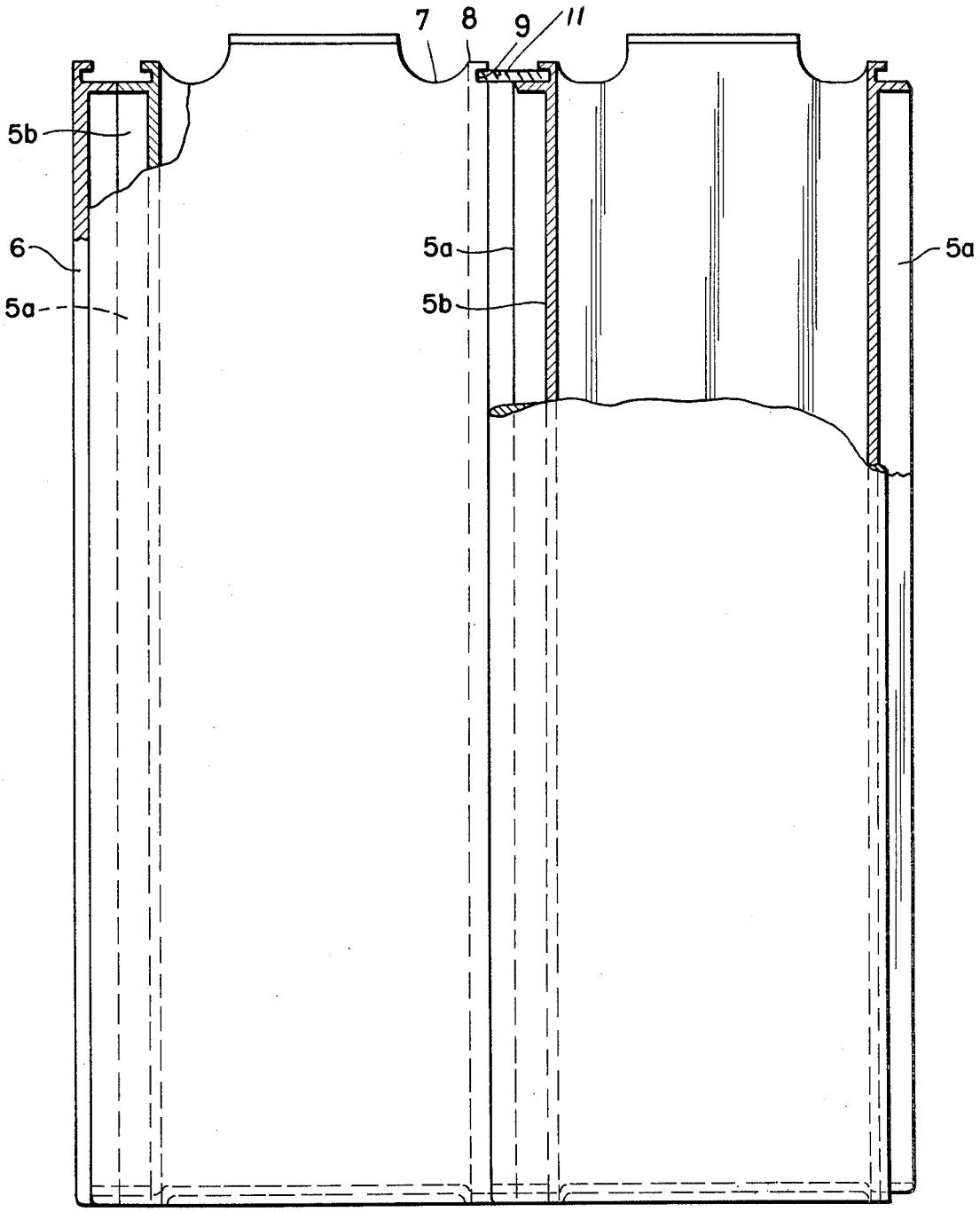
FIG. 2 is a partially sectioned plan view of two casettes according to FIG. 1 that have been connected together.
Figure 3:
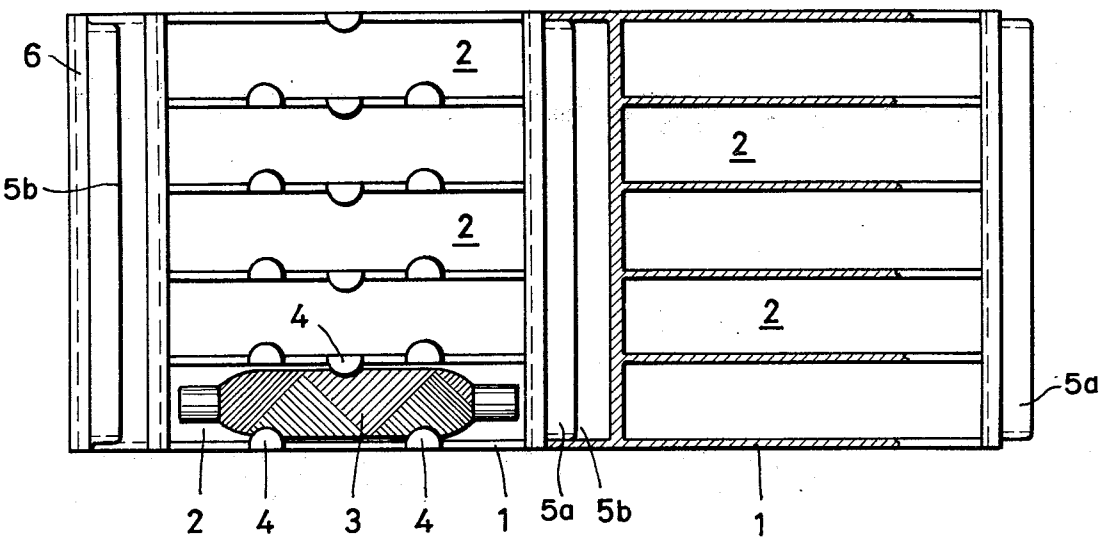
FIG. 3 is a partially sectional view of the front output side of the casettes in FIG. 2.

FIGS. 1 to 3 illustrate a casette generally designated at 1 and formed of a longitudinal, rectangular box being quadriform in section and having a series of vertically spaced partitions defining a series of yarn reel channels 2, running one above the other. Each channel is provided with a pressure spring system (not illustrated) of a known type to assure the automatic advance of the yarn reels 3. Opposed yieldable noses 4 at the forward end of said partitions retain the yarn reels at the open ends of the channels 2 in the channel opening.

Adjacent casettes, FIG. 3, are positively connected with one another at their sides by a tongue 5*a* and groove 5*b* spring connection. Said connection includes a tongue formation on one side of each casette which is yieldably and frictionally nested within a corresponding groove on the other side of each casette.

The external side groove of a row of casettes is covered by a supplementary tongue member 6.

At the vertical edges of the respective front output sides 7 of the casettes, there are provided lateral projections 8 having opposed outwardly directed grooves 9 extending parallel to the front sides of said casettes. In the grooves 9 of the respective adjacent casettes are inserted slide rails 11, serving as indicating strips for color and number and for preventing longitudinal shifting of one casette with respect to another.

Figure 4:
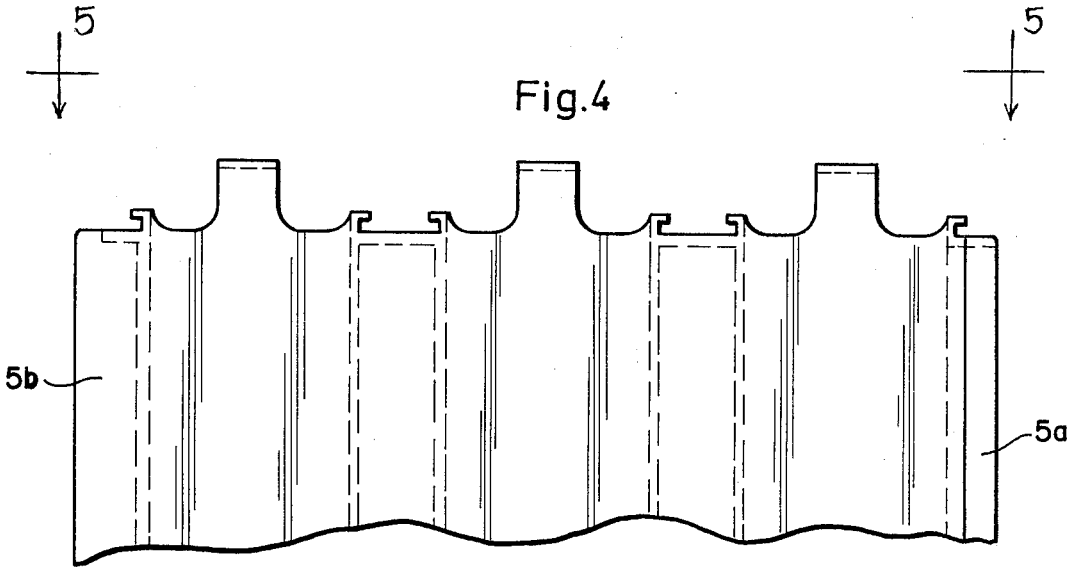
FIG. 4 is a fragmentary plan view of another embodiment of the casette.
Figure 5:
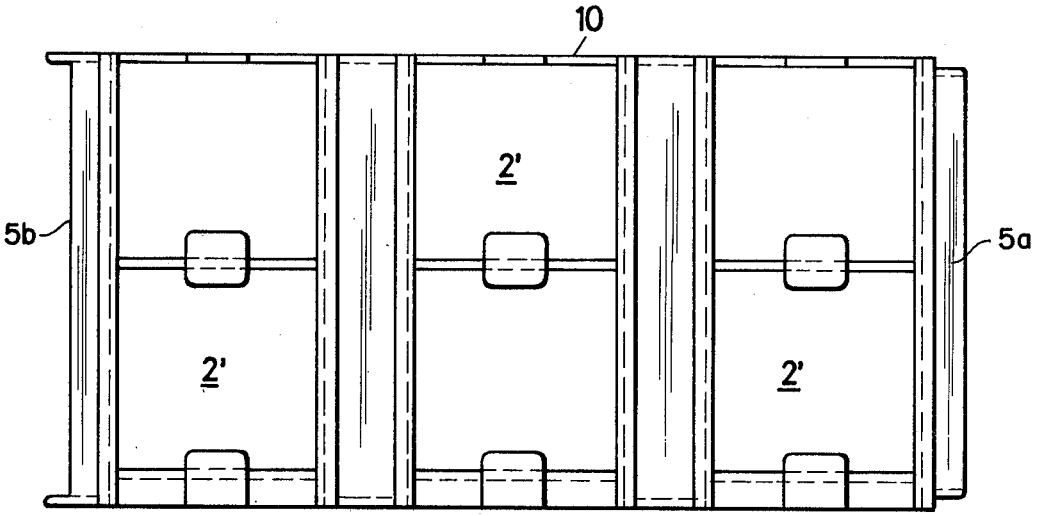
FIG. 5 is a view of the front of the casette taken in the direction of arrows 5—5 of FIG. 4.

FIGS. 4 and 5 illustrate a casette 10 having twice the width as casette 1 and being provided with altogether 6 channels 2'. Each two of which are disposed one above the other and serve to receive the relatively narrow yarn reels of larger diameter. The principal structure of the casette 10 is like the one illustrated in the embodiment of FIGS. 1 to 3.

The casettes are composed to constitute a mechanical dispensing device by being placed in a frame structure (not illustrated) of a size that is in keeping with the demand placed on it. The casettes can be readily exchanged in the completed device by removing the rails forming the yarn color count strips and withdrawing the desired casette by pulling it out. Loading the casettes with yarn reels is effected — on account of the use of the pressure spring system — towards the front, i.e., from output side, so that the dispensing device must not be accessible from behind.

Having described my invention, reference should now be had to the following Claims.

I claim:

1. In combination, at least a pair of quadriform casettes for dispensing yarn reels, said casettes being assembled side-by-side, each casette including front and side walls and a series of vertically spaced laterally elongated channels open at their front walls for dispensing, one at a time, a series of parallel yarn reels stored within each channel;

reel stop means at the front of each channel;

the opposed side walls of each casette having a respective resilient tongue and groove formation, with the tongue on one side wall of one casette resiliently nested within the corresponding groove on the side wall of an adjacent casette laterally interconnecting said casettes;

each casette having along its front wall at its side outwardly directed grooved projections;

the adjacent projection between said casettes being opposed defining an upright channel;

and a color-identifying strip projected into said channel retaining said casettes against relative longitudinal movement.

* * * * *